United States Patent [19]

Larson

[11] Patent Number: 5,050,576

[45] Date of Patent: Sep. 24, 1991

[54] CROSS HAIR BOW SIGHT

[75] Inventor: Marlow W. Larson, Ogden, Utah

[73] Assignee: Browning, Morgan, Utah

[21] Appl. No.: 606,535

[22] Filed: Oct. 31, 1990

[51] Int. Cl.[5] ..... F41G 1/46; F41B 5/00

[52] U.S. Cl. ..... 124/87; 33/265

[58] Field of Search ..... 124/23.1, 24.1, 25.6, 124/86, 87, 88; 33/265

[56] References Cited

U.S. PATENT DOCUMENTS

| | | | |
|---|---|---|---|
| 2,778,701 | 1/1957 | Fleischer | 285/188 |
| 3,013,336 | 12/1961 | Pennington | 33/265 |
| 3,136,063 | 6/1964 | Stebbins | 124/87 |
| 4,120,096 | 10/1978 | Keller | 33/265 |
| 4,224,741 | 9/1980 | Perry | 33/265 |
| 4,305,208 | 12/1981 | Larson | 33/265 |
| 4,400,887 | 8/1983 | Mason | 33/265 |
| 4,417,403 | 11/1983 | Strange | 33/265 |
| 4,449,303 | 5/1984 | Larson | 33/265 |
| 4,462,163 | 7/1984 | Tentler et al. | 33/265 |
| 4,535,544 | 8/1985 | Jones et al. | 33/265 |
| 4,711,036 | 12/1987 | Morris | 33/265 |
| 4,794,702 | 1/1989 | Martin | 33/265 |
| 4,796,364 | 1/1989 | Amacker | 33/265 |
| 4,884,347 | 12/1989 | Larson | 33/265 |

*Primary Examiner*—Peter M. Cuomo
*Assistant Examiner*—John A. Ricci
*Attorney, Agent, or Firm*—Trask, Britt & Rossa

[57] ABSTRACT

A bow sight is provided with a plurality of racks with serrations adapted to receive sight pins. The serrations of the respective racks are out of vertical registration with each other to provide closely spaced elevational adjustments of the sight pins.

7 Claims, 2 Drawing Sheets

CROSS HAIR BOW SIGHT

BACKGROUND

1. Field

This invention pertains to archery bow sights and provides an improved cross hair sight for archery bows.

2. State of the Art

Representative archery bow sights are disclosed by U.S. Pat. Nos. 2,778,701; 3,013,336; 4,120,096; 4,224,741; 4,305,208; 4,400,887; 4,417,403; 4,449,303; 4,462,163; 4,711,036; 4,794,702; and 4,796,364. U.S. Pat. No. 4,884,347 describes a modern version in which a plurality of sight pins may be positioned at selected vertical elevations corresponding to target distances. All of the prior art sights are limited in the relative vertical pin positions available for selection. It is thus not feasible with these sights to place pins in as closely spaced an arrangement as is desired for use with arrows launched at high velocities to travel in relatively flat trajectories.

SUMMARY OF THE INVENTION

The present invention provides a structural arrangement which accommodates a much closer sight pin placement than has heretofore been available. Individual sight pins can be set in very close vertical proximity to each other. A vertical monofilament line may be incorporated in conventional fashion to provide for windage adjustment. The structural components of this invention are arranged to offer a high level of sight visibility and convenient adjustability of both the windage cross hair and individual sight pins. The sight of this invention may be used with all types of archery bows, but it is particularly advantageous for use with high velocity compound bows, especially when these bows are fitted with an overdraw system.

A large number, typically 6 or more, of individual sight pins can be set vertically within a very small vertical space, typically ⅜ inch. Individual pins may be assigned distinct individual colors, preferably fluorescent, for quick identification and good visibility under low light conditions. A serrated vertical rack provides firm horizontal and vertical locking which maintains precise positioning under rigorous hunting conditions.

For maximum accuracy, a peep sight may be used in combination with the pin sight of this invention, but use of such auxiliary sights is optional.

BRIEF DESCRIPTION OF THE DRAWINGS

In the drawings, which illustrate that which is currently regarded as the best mode for carrying out the invention.

DESCRIPTION OF THE ILLUSTRATED EMBODIMENT

Figure 1:
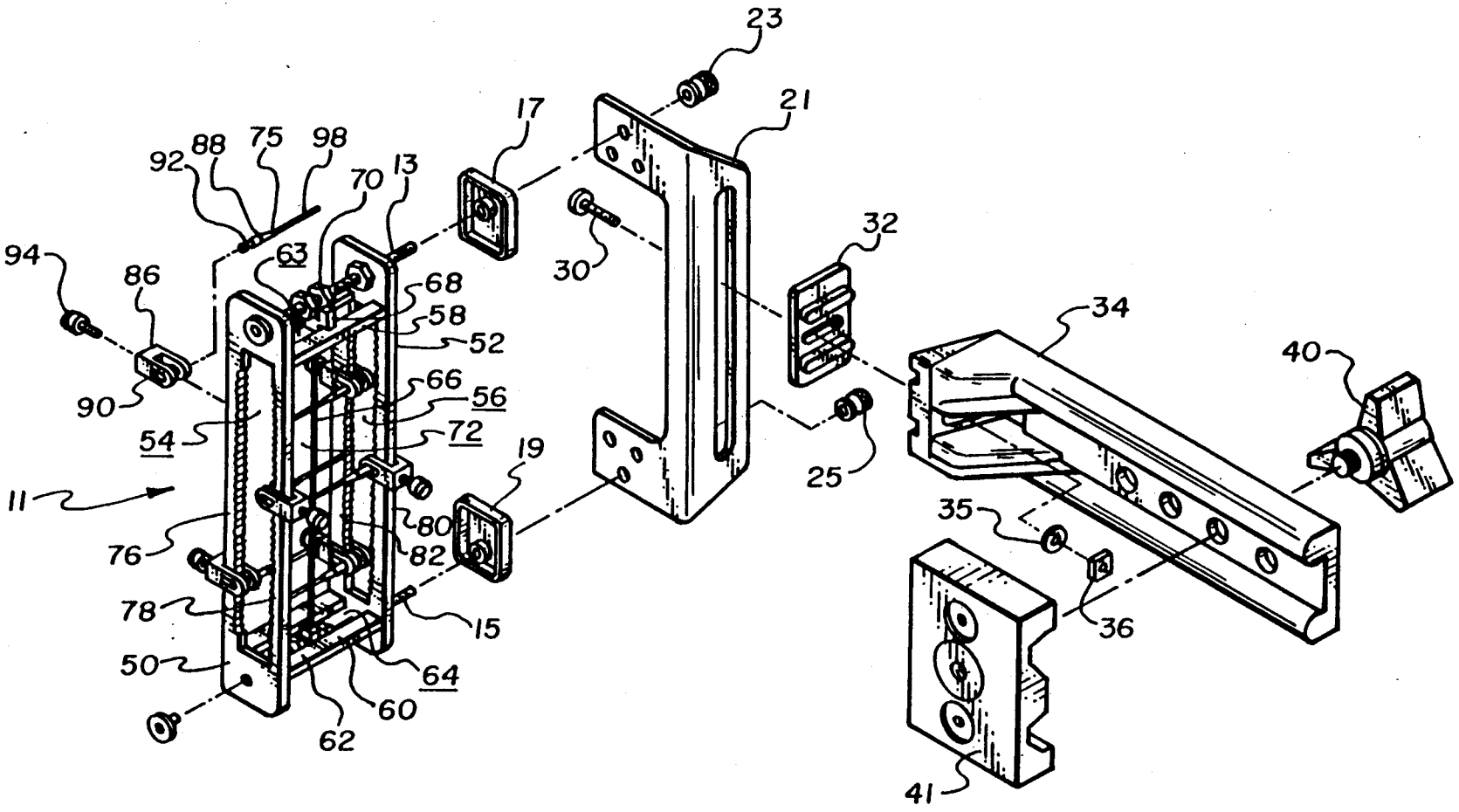
FIG. 1 is an exploded view illustrating the components of a preferred embodiment of the sight of this invention.

As illustrated, a sight body, designated generally 11, is attachable to the handle riser of a bow (not shown) in conventional fashion. Thus, for example, the sight body 11 may be attached by bolts 13, 15 through spacers 17, 19 to a sight plate 21, being held in place by knurled brass nuts 23, 25. The sight plate 21 may, in turn, be attached by a screw 30 through an adjustment block 32 to an extension bar 34, being fastened by the washer 35 and nut 36 shown. The extension bar 34 may be fastened to the bow by means of the bolt and knob 40 turned into a side mount extension bracket 41 carried by the handle riser of the bow (not shown).

The sight body of this invention includes a pair of serrated mounting brackets 50, 52. Each bracket 50, 52 comprises a central slot or aperture, 54 and 56, respectively. The brackets 50, 52 are held approximately parallel each other by means of a horizontal top support 58 and a horizontal bottom support 60. As shown, each of the supports 58, 60 is formed of spaced elements 62 which define a first slot 63 in the top support 58 and a second slot 64 in the bottom support 60. A monofilament windage cross hair 66 is held parallel and between the mounting brackets 50, 52 by means of fixtures 68 supported by the elements 62 in the slots 63, 64. It may be positioned as appropriate by means of horizontal adjustment nuts 70.

In normal use, the brackets 50, 52 and cross hair 66 are held approximately vertically with respect to the earth's surface. Sighting is accomplished by looking through a window 72 between the brackets 50, 52, past the cross hair 66 and a selected vertical sight pin 75. Sight pins 75 may be positioned at various elevations with respect to the brackets 50, 52 as appropriate for various target distances.

Figure 2:
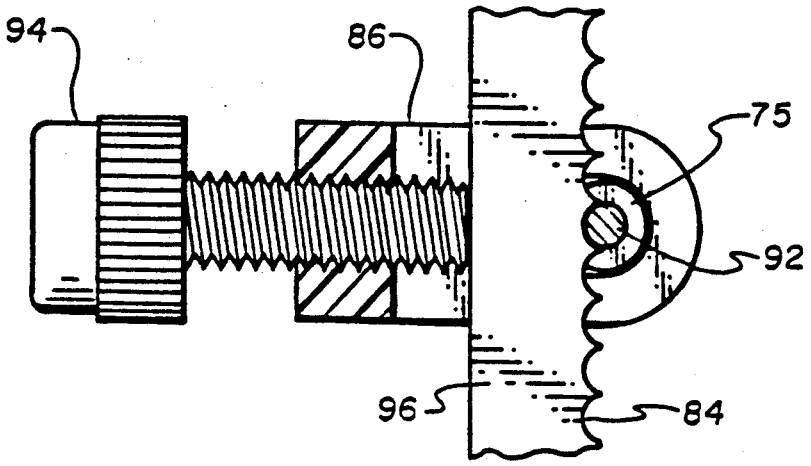
FIG. 2 is an enlarged fragmentary view, partially in section, illustrating one of the components shown in FIG. 1.
Figure 3:
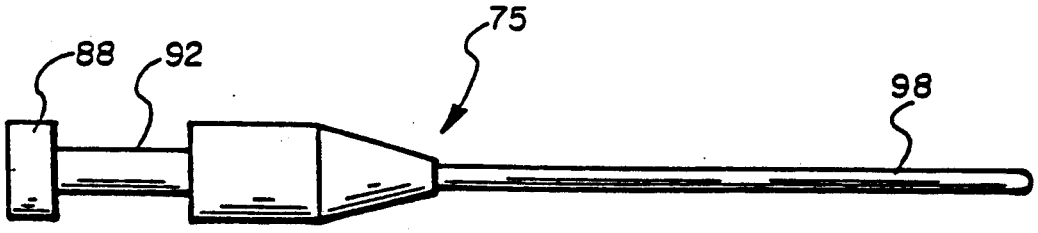
FIG. 3 is an enlarged perspective view of a sight pin.

The bracket 50 includes a pair of serrated racks 76, 78. The bracket 52 similarly includes a pair of serrated racks 80, 82. The individual serrations 84 (FIG. 2) of each of the racks 76, 78, 80, 82 serve as receivers for a sight pin. As best shown by FIG. 2, a pin 75 is clamped against a receiver serration 84 by means of sight pin clip 86. Referring to FIG. 3, each pin 75 includes a body element 88 which is insertable through the slots 90 (FIG. 1) of a clip 86. The body element 88 includes a portion 92 of reduced diameter appropriate to register with a serration 84 (FIG. 2). By turning the finger screw 94 against the outer edge 96 of a rack 76, 78, 80, 82, the portion 92 is brought into locking engagement with a selected serration 84. By loosening the screw 94, a pin 75 may be relocated to any selected serration 84 in any rack 76, 78, 80, 82. A shaft portion 98 of each pin 75 thus extends horizontally into the window 72 past the cross hair 66.

A significant feature of this invention is that corresponding serrations of the racks 76, 78 of the bracket 50 are at different elevations with respect to each other and the bottom support 60. Each serration 84 of the rack 76 is out of vertical registration with each serration of the rack 78 so that pins located in rack 76 will never be duplicates in elevation of pins located in rack 78. The same relationship is maintained with respect to the respective serrations 84 of the racks 80, 82 of the bracket 52. In the preferred embodiments, each serration 84 of each rack 76, 78, 80, 82 is at a unique elevation so that a pin located in any serration 84 of any rack 76, 78, 80, 82 corresponds to a unique vertical sighting plane. The out of registration vertical spacings are closer than adjacent serrations of any individual rack. Such an arrangement provides for fine sighting adjustments while maintaining rigid support for individual sighting pins. Vertical spacings of adjacent pins may be sufficiently close to each other to accommodate several pins 75 within the space defined by adjacent serrations 84 of an individual rack 76, 78, 80, 82.

The structural arrangement of this invention makes it practical to position vertical sight pins 75 selectively in the racks 76, 78, 80, 82 for a large variety of target distances. The pins may be provided in a variety of colors keyed to specific distances to avoid confusion.

In practice, sight pin adjustment may be done with little effort. A target is set up at a fixed distance; e.g., 20 yards. A sight pin 75 of a distinct color; e.g., white, is positioned in a serration 84 near the top of window 72. An arrow is launched, using the sight. If the arrow strikes high, the screw 94 is loosened and the pin 75 is moved to a serration (in any of the racks 76, 78, 80, 82) vertically higher. If the arrow strikes low, the pin 75 is moved vertically down. The screw 94 is re-tightened to hold the pin at its proper location. If major elevation adjustment is required, the entire sight body 11 may be moved by adjusting the position of the sight plate 21 with respect to the extension bar 34. A windage adjustment can be made by moving the cross hair 66 appropriately once the elevation of a first pin 75 is established.

Additional pins may then be selected for additional standard distances; e.g., 30, 40, 50, 60 and 70 yards. The elevation of each of these pins may be adjusted following the procedure explained in connection with the top pin.

The stable mounting of the individual sight pins 75 in the individual vertically stacked serrations 84 represents a significant improvement in archery sights generally. This feature may be embodied in sights independently of the vertical registration of the serrations of a plurality of racks 76, 78, 80, 82. Embodiments having a single such rack are within contemplation. Other embodiments with a single sight pin, particularly in sights having a single rack, are also within contemplation.

References herein to specific details of the illustrated embodiments is not intended to limit the scope of the appended claims, which themselves set forth those details regarded as important to the invention.

What is claimed is:

1. A sight for archery bows, comprising:

a body member with a pair of approximately parallel vertical side elements, together defining a sight window, each said side element including:

a pair of approximately parallel vertical serrated rack elements, the respective said pairs of rack elements being oriented to define first and second access slots communicating with said sight window, individual serrations of each said rack element being out of vertical registration with corresponding serrations of the access slot with which said rack element is associated; and a plurality of sight pins, each having a body portion adapted to be clamped to register with a selected said serration within a said access slot, and a shaft portion which extends horizontally into said window when said body portion is so clamped into position.

2. A sight according to claim 1, wherein each serration of each rack is provided at a unique vertical elevation, said unique elevations being more closely spaced than are the individual serrations of the respective rack elements.

3. A sight according to claim 2, wherein a first plurality of sight pins is associated with said first access slot and a second plurality of sight pins is associated with said second access slot.

4. A sight according to claim 3, wherein each said sight pin is of a distinctive color, coded to correspond to a selected target distance.

5. A sight for archery bows, comprising:

a body member with an approximately vertical side element adjacent a sight window, said side element including:

a pair of approximately parallel vertical serrated rack elements, the respective said rack elements being oriented to define an access slot communicating with said sight window, individual serrations of each said rack element being out of vertical registration with corresponding serrations of the other said rack element; and a plurality of sight pins, each having a body portion adapted to be clamped to register with a selected said serration within said access slot, and a shaft portion which extends horizontally into said window when said body portion is so clamped into position.

6. A sight according to claim 5, wherein each serration of each rack is provided at a unique vertical elevation, said unique elevations being more closely spaced than are the individual serrations of the respective rack elements.

7. A sight according to claim 5, including an approximately vertical cross hair disposed in said sight window adjacent the shaft portions of said plurality of sight pins.

* * * * *